United States Patent [19]

Tomaru

[11] 4,337,691

[45] Jul. 6, 1982

[54] VALVE DRIVING APPARATUS

[75] Inventor: Hisao Tomaru, Yamanashi, Japan

[73] Assignee: Kitazawa Valve Co., Ltd., Tokyo, Japan

[21] Appl. No.: 109,403

[22] Filed: Jan. 3, 1980

[30] Foreign Application Priority Data

Jun. 8, 1979 [JP] Japan ..... 54-78108[U]
Jun. 8, 1979 [JP] Japan ..... 54-78110[U]
Jun. 8, 1979 [JP] Japan ..... 54-78111[U]

[51] Int. Cl.[3] ..... F01B 9/00

[52] U.S. Cl. ..... 92/138; 92/DIG. 1; 92/130 R; 92/166; 92/140; 74/104; 251/58

[58] Field of Search ..... 92/59, DIG. 1, 130 R, 92/130 C, 130 D, 138, 140, 166; 251/58; 74/104; 91/174

[56] References Cited

U.S. PATENT DOCUMENTS 3,152,520 10/1964 Heese ..... 92/138
3,261,266 7/1966 Ledeen et al. ..... 92/138
3,376,895 4/1968 Pray ..... 92/138
3,507,192 4/1970 Stokke ..... 92/138
3,614,913 10/1971 Clark ..... 92/138

*Primary Examiner*—Paul E. Maslousky

*Attorney, Agent, or Firm*—Wenderoth, Lind & Ponack

[57] ABSTRACT

A valve driving apparatus is provided with cylindrical bearing members made of a synthetic resin or a copper alloy and used for a piston rod and for a drive shaft, a lining member made of a synthetic resin for coating the inner wall of an apparatus and a resilient member made of a synthetic rubber or a synthetic resin and inserted in a groove of a piston so as to protect the valve driving apparatus from the disadvantages of wear, frictional resistance and energy loss which are produced by a reciprocating movement of the piston and the piston rod. Also a valve driving apparatus utilizing a scotch yoke type movement conversion-transmission mechanism is provided with cylindrical bearing members made of a synthetic resin or a copper alloy and attached to pins installed on a piston rod so as to prevent the aforementioned disadvantages from occurring between the pins and the scotch yokes. And a spring-return type valve driving apparatus is provided with one or two cylindrical thrust bearing members disposed between one end of a compression coil spring and a box cover and/or between the other end of the spring and a spring holder so as to avoid a twisting phenomenon of the spring.

3 Claims, 9 Drawing Figures

VALVE DRIVING APPARATUS

BACKGROUND OF THE INVENTION

The present invention relates to a valve driving apparatus provided for a valve such as a ball valve, butterfly valve, plug valve, gate valve, etc. and adapted to cause a valve stem thereof to be rotated to thereby open and shut the valve body.

There have heretofore been proposed two kinds of valve driving apparatuses, one of which is a double-acting cylinder type valve driving apparatus utilizing the reciprocating movement within a cylinder and the other of which is a spring-return type valve driving apparatus utilizing the reciprocating movement motivated by a compression coil spring in conjunction with movement within a cylinder. Generally, the reciprocating movement is converted into a rotating movement and simultaneously transmitted to a driving shaft by a conversion mechanism of a combination rack and pinion type, a scotch yoke type or a link type and thereby the valve body provided on the valve stem connected with the driving shaft is either opened or shut.

The conventionally known valve driving apparatus of a double-acting cylinder type has the disadvantages that a continuous reciprocating movement of the piston of the cylinder and a continuous rotating movement of the driving shaft give wear to the bearing portions for the piston rod and for the driving shaft resulting in the replacement of the bearing portions with new ones in a comparatively short period of time, and that the use of the apparatus for a long period of time reduces the driving efficiency due to the formation of rust on the inner wall of the cylinder, high frictional resistance between the cylinder and the piston and, with the utilization of the scotch yoke type conversion mechanism, high frictional resistance between the pins and scotch yokes.

In the conventionally known valve driving apparatus of a spring-return type, continuous compression and extension of the compression coil spring disposed inside the apparatus gives rise to relative displacements in the rotating direction between the both ends of the compression coil spring and the both end-receiving portions and further gives rise to a twisting phenomenon of the spring which is an unavoidable characteristic feature of the spring. Assuming that one end of the spring and the portion of the apparatus receiving the one end of the spring are such that they cannot easily be slid relative to each other, the other end of the spring is given a rotating movement which is transmitted to the spring holder fixed to the piston rod. That is to say, the rotating movement of the spring holder is transmitted to the piston rod and further to the piston. This will create the possibility that the conversion mechanism disposed between the piston rod and the driving shaft be given an excessive movement or force and thereby causing disengagement between the pins and the scotch yokes in the scotch yoke type conversion mechanism, disengagement between the toothed wheels in the combination rack and pinion type conversion mechanism, etc. However, since the conversion mechanism has a construction such that no such excessive movement is made though an excessive force exerted on the conversion mechanism, attention is directed toward the aforementioned unavoidable phenomenon. That is to say, the conventionally known valve driving apparatus of a spring-return type has the disadvantages that there occurs displacement and friction between the both ends of the spring and the both end-receiving portions within the apparatus to thereby give rise to an energy loss, damage and wear, that the rotating action of the valve stem may possibly be obstructed and therefore the apparatus cannot be used with precision and stability for a long period of time for the aforementioned reasons.

SUMMARY OF THE INVENTION

In view of the disadvantages described above, the present invention has been proposed.

An object of the present invention is to provide a valve driving apparatus capable of solving the problem of wear of the bearing portions for the piston rod and for the driving shaft.

Another object of the present invention is to provide a valve driving apparatus which has the driving efficiency enhanced by a reduction of the frictional resistance between the pins and the scotch yokes in the scotch yoke type conversion mechanism.

Still another object of the present invention is to provide a valve driving apparatus which is substantially durable and corrosion-proof.

Yet another object of the present invention is to provide a valve driving apparatus of a spring-return type which is substantially capable of solving the above-described problems of wear, energy loss, damage caused by the displacement and friction between the ends of the coil spring and the both end-receiving portions within the apparatus.

To attain the objects described above, according to the present invention, there are proposed valve driving apparatuses provided with: (1) cylindrical bearing members made of a synthetic resin or a copper alloy which are formed in the same shape and diameter and are attached to the piston rod which is subject to a reciprocating movement and the drive shaft which is subject to a rotating movement so that they can respectively replace each other since the wear between the cylindrical bearing members for the shaft and the rods are different due to the different movements of the piston rod and the drive shaft; (2) other cylindrical bearing members made of the same material as the aforementioned cylindrical bearing members and attached to the pins in the case of a scotch yoke type conversion mechanism so as to reduce the frictional resistance between the pins and the scotch yokes; (3) a lining member made of a synthetic resin and applied to the inner wall of the apparatus proper and a resilient member, made of a material such as synthetic rubber, provided in a groove formed on the circumference of the piston to thereby enhance the durability and corrosion-proofness of the apparatus; and (4) at least one cylindrical thrust bearing member positioned on at least one of the portions for receiving the ends of the compression coil spring in the case of the spring-return type valve driving apparatus so as to reduce the frictional resistance between the both ends of the spring and the both end-receiving portions within the apparatus.

These and other objects and characteristic features of the present invention will become apparent from the description to be given hereinafter in detail with reference to the accompanying drawing.

DETAILED DESCRIPTION OF PREFERRED EMBODIMENT

The present invention will be described hereinafter in detail with reference to the accompanying drawing.

Figure 1:
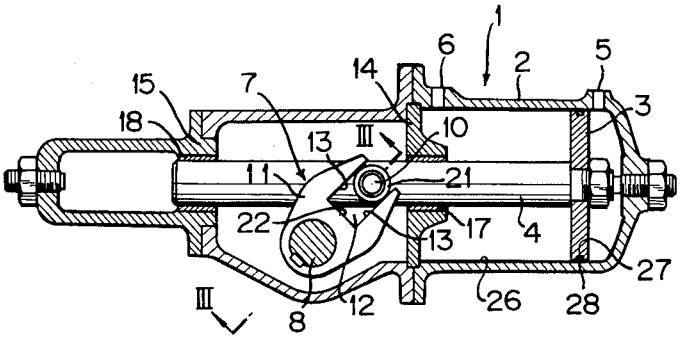
FIG. 1 is a lateral cross sectional view illustrating one embodiment of the valve driving apparatus according to the present invention.
Figure 6:
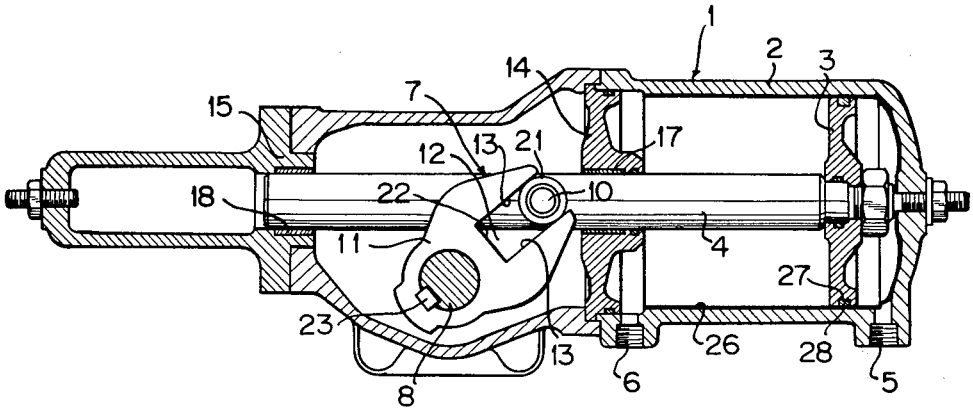
FIG. 6 is a lateral cross sectional view illustrating still another embodiment of the valve driving apparatus according to the present invention.

FIGS. 1 and 6 are lateral cross sectional views respectively illustrating the double-acting cylinder type valve driving apparatuses of the present invention. A cylinder 2 is provided on an apparatus 1 and has a piston 3 which is slidably movable. A piston rod 4 is fixed to the piston and the cylinder 2 is provided with ports 5, 6 which serve as an inlet and an outlet for a pressurized fluid such as of air, oil, etc. The introduction of the pressurized fluid into the cylinder via the ports causes the piston and the piston rod to be subjected to a reciprocating movement. The reciprocating movement is converted into a rotating movement and simultaneously transmitted to a drive shaft 8 by means of a conversion mechanism 7 provided on the piston rod 4. The rotating movement of the drive shaft is transmitted to a valve stem (not illustrated) connected to the drive shaft to thereby open or shut a valve.

Figure 2:
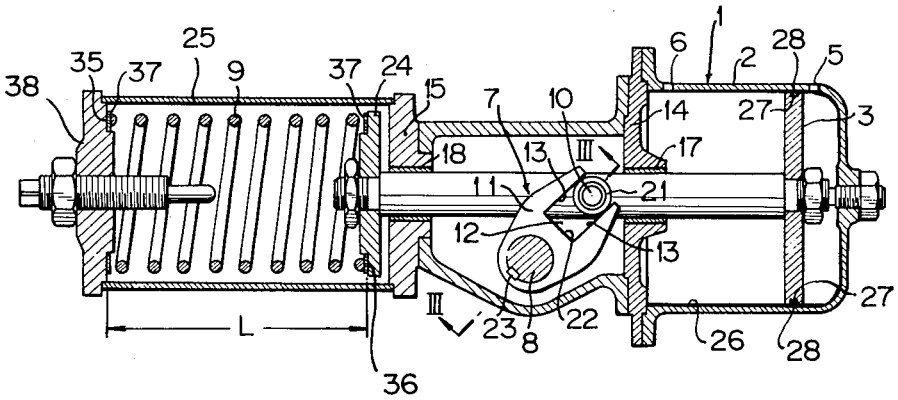
FIG. 2 is a lateral cross sectional view illustrating another embodiment of the valve driving apparatus according to the present invention.
Figure 8:
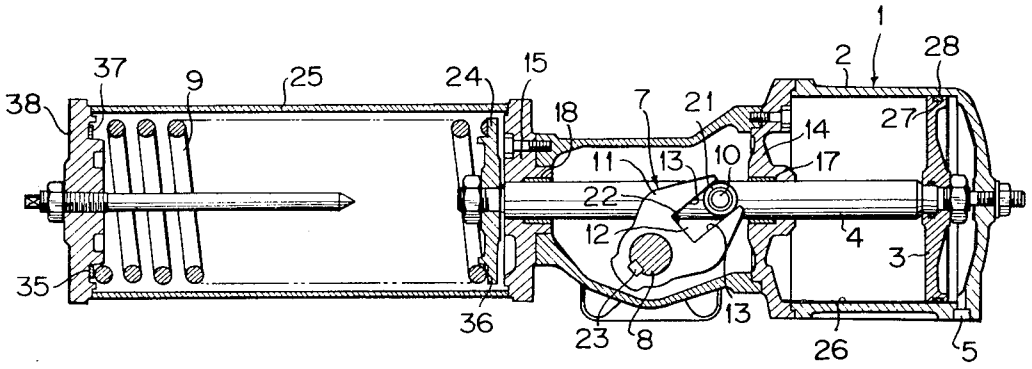
FIG. 8 is a lateral cross sectional view illustrating yet another embodiment of the valve driving apparatus according to the present invention.
Figure 9:
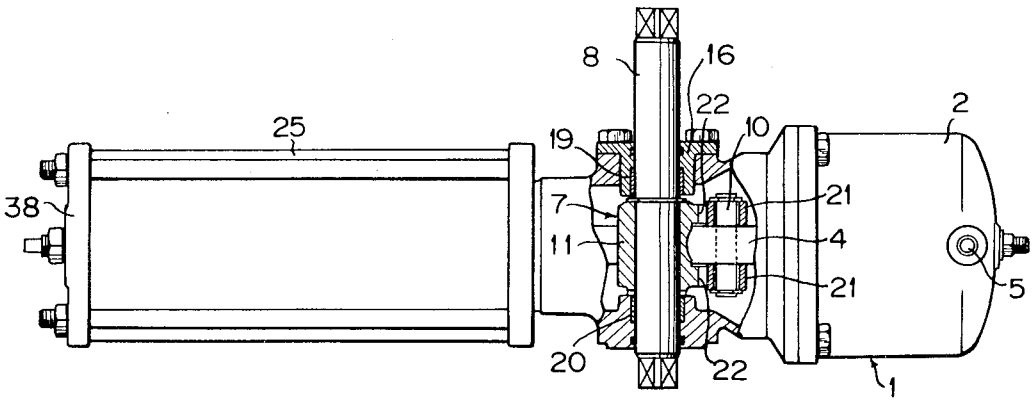
FIG. 9 is a partially cutaway plan view of FIG. 8.

FIGS. 2 and 8 are lateral cross sectional views illustrating the spring-return type valve driving apparatuses of the present invention. The piston rod 4 is moved by the introduction of the pressurized fluid into the cylinder 2 to thereby compress a compression coil spring 9. The spring 9 biases the piston rod 4 to the original position by the extension thereof due to its own restoring force when the pressure of the pressurized fluid is substantially the same as the atmospheric pressure. The reciprocating movement of the piston rod is converted and simultaneously transmitted as a rotating movement to the drive shaft 8 by the conversion mechanism 7. Reference numeral 23 denotes a key for fixing the conversion mechanism on a drive shaft, 24 a spring holder, 25 a spring box and 38 a box cover.

In these valve driving apparatuses, a scotch yoke type conversion mechanism is used as illustrated. The mechanism 7 comprises pins 10 provided on the piston rod 4 and scotch yokes 11 each fixed to the drive shaft 8 and each having an opening 12 defined by a pair of opposing sliding surfaces 13 and a thrust surface 22. Each of the pins reciprocates in the respective opening and slides on the sliding surfaces. As for the conversion mechanism, the existing mechanism of a combination rack and pinion type or a link type may be used in the present invention in place of the scotch yoke type conversion mechanism.

Figure 3:
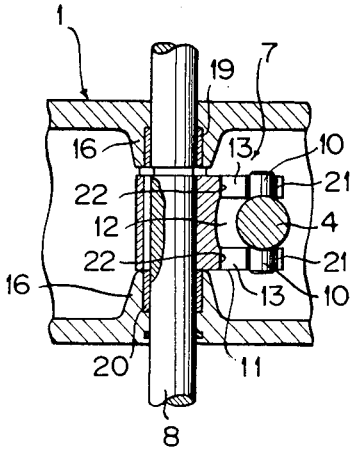
FIG. 3 is an enlarged cross section taken along the line III—III in FIG. 1 or 2.
Figure 7:
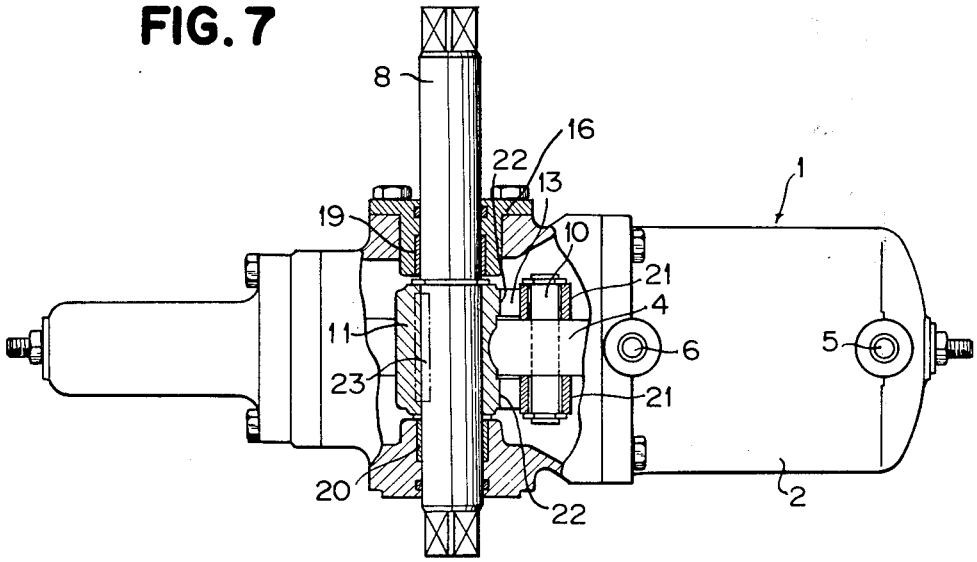
FIG. 7 is a partially cutaway plan view of FIG. 6.

Since bearing supports or portions 14, 15 support the reciprocating movement of the piston rod 4, whereas bearing supports or portions 16, 16 (FIGS. 3 and 7) support the rotating movement of the drive shaft 8, the pressure exerted on the former bearing portions and that exerted on the latter bearing portions are different and, therefore, repetitive reciprocating and rotating movements create wear to the respective bearings in different sections thereof. In view of this fact, engineering design has been directed toward the use of cylindrical bearing members which are identical in material, shape and diameter. Into the bearing supports 14, 15 for the piston rod 4 and the bearing supports 16, 16 for the drive shaft 8, cylindrical bearing members 17, 18, 19, 20 made of a synthetic resin or a copper alloy and formed in the same shape and diameter are inserted respectively therein. To be more specific, the cylindrical bearing members protect the bearing portions from wear and at the same time can be replaced with each other since these are of same material, shape and diameter because there are differences in wear between the cylindrical bearing members for different bearing portions due to different movements between the piston rod and the drive shaft. After use of the apparatus for some period of time wherein the cylindrical bearing members 17, 18 are used for the piston rod 4 and the cylindrical bearing members 19, 20 are used for the drive shaft 8, the members 17, 18 can be used or the drive shaft 8 and the members 19, 20 can be used for the piston rod because of the aforementioned difference in wear therebetween. This replacement brings about substantially the same function and effect as in the case of replacement of these cylindrical bearing members with completely new ones. Use of these cylindrical bearing members, thus, makes the apparatus have excellent durability and economization and enhances the drive efficiency of the apparatus since the apparatus functions smoothly and precisely for a long period of time.

Now, a valve drive apparatus using a scotch yoke type conversion mechanism has been considered. Since the openings 12 of the scotch yokes 11 and the pins 10 are respectively engaged with each other, problems of wear and damage may possibly exist. In view of these problems, cylindrical bearing members 21 made of a synthetic resin or a copper alloy are rotatably provided on the pins 10 through the medium of bearing portions. Use of the cylindrical bearing members can reduce the frictional resistance between the scotch yokes and the pins when the pins are sliding on the sliding surfaces 13 of the scotch yokes 11 or when the pins are brought into thrusting contact with the thrust surfaces 22 which is when the openings 12 are disposed at right angles relative to the piston rod 4 and therefore, the members 21 further enhance the driving efficiency of the apparatus.

Figure 4:
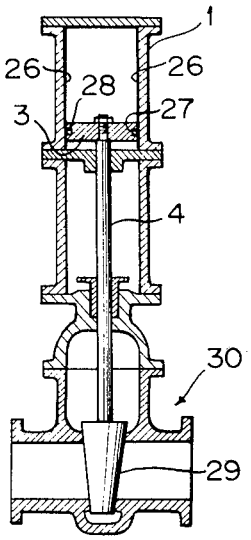
FIG. 4 is a longitudinal cross sectional view illustrating a cylinder-operation type gate valve on which the valve driving apparatus of the present invention is provided.
Figure 5:
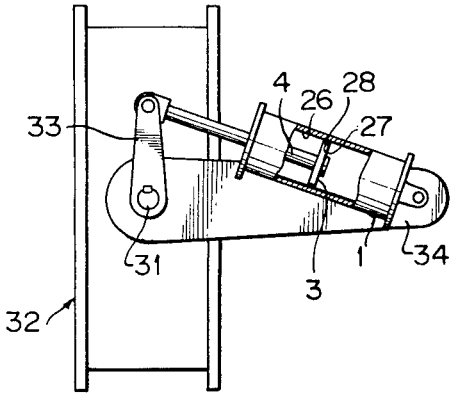
FIG. 5 is a partially cutaway plan view illustrating a butterfly valve on which the valve driving apparatus of the present invention is provided.

FIG. 4 is a longitudinal cross sectional view of a cylinder-operation type gate valve. In the Figure, reference numeral 30 is a gate valve and denoted by 29 is a valve body of the gate valve. FIG. 5 is a partially cutaway plan view of a butterfly valve 32, wherein reference numeral 31 is a drive shaft connected to a valve stem of the butterfly valve, 33 a rotating member installed on the drive shaft 31 and 34 a supporting plate for pivotally supporting the apparatus 1.

Since a valve driving apparatus utilizes the reciprocating movement of a piston, the piston is required to slide smoothly within the apparatus. The present invention also provides a valve driving apparatus wherein the inner wall of the apparatus 1 is coated with a lining member 26, having low frictional resistance and made of a material such as a synthetic resin, and the piston 3 is provided on the peripheral surface thereof having a circular groove 27 wherein a circular resilient member 28 having low frictional resistance and made of a synthetic rubber or a synthetic resin, etc., so that the resilient member slides on the lining member. The inner wall of the apparatus is coated with a lining member which prevents rust and, in conjunction with the resilient member, also prevents damage and wear due to its own resilience and also reduces frictional resistance therebetween. Therefore, the present invention provides a valve driving apparatus which is excellent in durability, substantially corrosion-proof and exhibits a high driving efficiency.

Referring to FIGS. 2 and 8, the compression coil spring 9 is compressed and extended along the length L when the piston rod 4 reciprocates for the purpose of transmitting to the drive shaft 8 the rotating movement converted from the reciprocating movement. In the movement of the spring along the length of L, relative displacements in the rotating movement are produced between the both ends of the spring 9 and the both end-receiving portions 35, 36 within the apparatus and then a twisting phenomenon of the spring occurs. In view of such phenomenon, the present invention provides a valve driving apparatus wherein one or two cylindrical thrust bearing members 37 such as a metallic plate coated with a tetrafluoroethylene resin, an oil-containing sintered metallic member or a copper alloy member, etc. are disposed between one end of the spring and the box cover 38 and/or between the other end of the spring and the spring holder 24. According to the present invention the twisting phenomenon, friction resulting from such phenomenon and wear due to such friction can substantially be prevented, with the result that both the conversion of the reciprocating movement into the rotating movement within the valve driving apparatus and the open-shut operation of the valve body are precisely effectuated.

As described above, the present invention substantially solves adverse problems such as wear, energy loss, and damage, etc. which have heretofore remained outstanding in the conventionally known valve driving apparatuses and, therefore, the invention provides a substantial contribution to the field.

What is claimed is:

1. In a valve driving apparatus having:

a cylinder;

a piston slidably positioned in said cylinder for reciprocating with respect to said cylinder;

a piston rod attached to said piston and slidably positioned within said apparatus;

a valve drive shaft rotatably positioned within said apparatus;

a conversion-transmission means operatively associated with said piston rod and said valve drive shaft for converting reciprocating movement of said piston rod to a rotational movement of said valve drive shaft; and piston rod bearing supports for supporting said piston rod, and drive shaft bearing supports for supporting said drive shaft;

the improvement comprising:

a plurality of cylindrical bearing members having the same shape and dimensions, each of said bearing members being respectively inserted into one of said bearing supports for respectively supporting said piston rod in sliding movement and supporting said drive shaft in rotational movement; and whereby said bearing members can be interchanged with each other.

2. The improvement as claimed in claim 1, further comprising:

a lining member of synthetic resin covering the inner periphery of said cylinder;

said piston member having a groove around the outer periphery thereof;

a resilient member fixedly attached within said groove and slidably engaging said lining member.

3. A valve driving apparatus as claimed in claim 1 in which said conversion-transmission means comprises:

pin means attached to said piston rod and having pin portions at substantially opposite circumferential portions thereof and extending radially outwardly therefrom;

further cylindrical bearing members respectively rotatably attached to the outer periphery of said pins; and a pair of scotch yokes attached to said drive shaft, each of said yokes having an opening therein having two opposed sliding surfaces which define a portion of the outer periphery of said opening slidably engaging one of said pair of further bearing members, said opening further having a thrust surface which defines a portion of the outer periphery of said opening and which is transverse to said sliding surfaces and which abuts the corresponding one of said pair of second bearing members during reciprocating movement of said piston rod.

* * * * *